US011835248B2

(12) United States Patent
Li et al.

(10) Patent No.: US 11,835,248 B2
(45) Date of Patent: Dec. 5, 2023

(54) CENTRAL AIR CONDITIONER, AIR CONDITIONER WATER SYSTEM, CONTROL METHOD THEREFOR, AND CONTROL DEVICE THEREOF

(71) Applicants: Shanghai Meicon Intelligent Construction Co., Ltd., Shanghai (CN); GD Midea Heating & Ventilating Equipment Co., Ltd., Foshan (CN)

(72) Inventors: Yuanyang Li, Shanghai (CN); Jie Fei, Shanghai (CN); Manning Huang, Shanghai (CN); Yide Qiu, Shanghai (CN); Jie Yan, Shanghai (CN)

(73) Assignees: SHANGHAI MEICON INTELLIGENT CONSTRUCTION CO., LTD., Shanghai (CN); GD MIDEA HEATING & VENTILATING EQUIPMENT CO., LTD., Foshan (CN)

( * ) Notice: Subject to any disclaimer, the term of this patent is extended or adjusted under 35 U.S.C. 154(b) by 231 days.

(21) Appl. No.: 17/459,864

(22) Filed: Aug. 27, 2021

(65) Prior Publication Data

US 2021/0389013 A1 Dec. 16, 2021

Related U.S. Application Data

(63) Continuation of application No. PCT/CN2020/083326, filed on Apr. 3, 2020.

(30) Foreign Application Priority Data

May 27, 2019 (CN) ..... 201910446559.X

(51) Int. Cl.
*F24F 11/64* (2018.01)
*F24F 11/85* (2018.01)
(Continued)

(52) U.S. Cl.
CPC ..... *F24F 11/64* (2018.01); *F24F 11/85* (2018.01); *F24F 2140/12* (2018.01); *F24F 2140/20* (2018.01)

(58) Field of Classification Search
CPC ..... F24F 11/64; F24F 11/85; F24F 2140/12; F24F 2140/20; F24F 5/0003; F24F 11/49;
(Continued)

(56) References Cited

U.S. PATENT DOCUMENTS

2009/0171512 A1* 7/2009 Duncan ..... F24F 11/30 62/157
2013/0125565 A1* 5/2013 Erpelding ..... F25B 49/02 62/126
(Continued)

FOREIGN PATENT DOCUMENTS

CN 1598437 A 3/2005
CN 102635921 A 8/2012
(Continued)

OTHER PUBLICATIONS

Shanghai Meichang Smart Construction Co., Ltd., First Office Action, CN Application No. 201910446559.X, dated Jun. 19, 2020, 8 pgs.
(Continued)

*Primary Examiner* — Santosh R Poudel
(74) *Attorney, Agent, or Firm* — Morgan, Lewis & Bockius LLP

(57) ABSTRACT

An air conditioner water system, a control method therefor, and a control device thereof, the method includes acquiring the pressure difference and temperature difference between a water intake pipe and a water discharge pipe of an air conditioner water system, the water intake pipe being connected to an inlet of a host module of the air conditioner water system, and the water discharge pipe being connected
(Continued)

to an outlet of the host module; detecting and confirming that the pressure difference is less than or equal to a preset pressure difference, and controlling the operating frequency of a water pump of the air conditioner water system according to the pressure difference; and detecting and confirming that the pressure difference is greater than the preset pressure difference, and controlling the operating frequency of the water pump of the air conditioner water system according to the temperature difference.

8 Claims, 10 Drawing Sheets

(51) Int. Cl.
*F24F 140/12* (2018.01)
*F24F 140/20* (2018.01)

(58) Field of Classification Search
CPC ..... F24F 11/88; F24F 2110/00; F24F 5/001; G06F 2113/14; G06F 2119/08; G06F 2119/14; G06F 30/18; G06F 30/28; G06F 2113/08; Y02B 10/40
See application file for complete search history.

(56) References Cited

U.S. PATENT DOCUMENTS

| | | | | |
|---|---|---|---|---|
| 2015/0122475 | A1* | 5/2015 | Baasch Sorensen | F24D 3/12 165/287 |
| 2017/0003679 | A1* | 1/2017 | Miura | F25B 25/005 |
| 2020/0096238 | A1* | 3/2020 | Hikone | F24D 3/18 |

FOREIGN PATENT DOCUMENTS

| | | | | | |
|---|---|---|---|---|---|
| CN | 102661672 | A | | 9/2012 | |
| CN | 104676837 | A | * | 6/2015 | F24F 11/30 |
| CN | 106168404 | A | * | 11/2016 | F24F 11/62 |
| CN | 106168404 | A | | 11/2016 | |
| CN | 106679103 | A | | 5/2017 | |
| CN | 106839275 | A | | 6/2017 | |
| CN | 206360877 | U | | 7/2017 | |
| CN | 108036464 | A | | 5/2018 | |
| CN | 108775661 | A | | 11/2018 | |
| CN | 109612055 | A | | 4/2019 | |
| CN | 110160230 | A | | 8/2019 | |
| WO | WO 2017221383 | A1 | | 12/2017 | |

OTHER PUBLICATIONS

Guangdong Midea HVAC Equipment Co., Ltd., International Search Report and Written Opinion, PCT/CN2020/083326, dated Apr. 3, 2020, 12 pgs.

* cited by examiner

CENTRAL AIR CONDITIONER, AIR CONDITIONER WATER SYSTEM, CONTROL METHOD THEREFOR, AND CONTROL DEVICE THEREOF

CROSS-REFERENCE TO RELATED APPLICATION

This application is a continuation of PCT International Application No. PCT/CN2020/083326, filed Apr. 3, 2020, which claims the benefit of the Chinese Patent Application No. 201910446559.X, filed on May 27, 2019, with China National Intellectual Property Administration, and entitled "Central air conditioner, air conditioner water system, control method therefor, and control device thereof," the entire content of each of which is incorporated herein by reference.

FIELD

The present disclosure relates to the field of electric appliance, and in particular relates to a central air conditioner, an air conditioner water system, and a control method and a control device for the same.

BACKGROUND

In the related art, an entire control process for an air conditioner water system usually uses only one control method, such as a pressure difference-based control method or a temperature difference-based control method. However, the problem existing in the related art includes: it is impossible to accurately reflect a change in a load of the air conditioner water system (when such a change in the load occurs) if the control method is only based on the pressure difference, which may lead to failure of the control system; when a great change in the load occurs, the air conditioner water system will be adjusted by the control system after a lag time if the control method is only based on the temperature difference, thus adversely affecting the timeliness and speed of control.

SUMMARY

The present disclosure aims to solve at least one of the above technical problems to a certain extent.

For this, a first objective of the present disclosure is to provide a control method for an air conditioner water system, so as to adaptively control an operating frequency of a water pump of the air conditioner water system.

A second objective of the present disclosure is to provide a control device for an air conditioner water system.

A third objective of the present disclosure is to provide an air conditioner water system.

A fourth objective of the present disclosure is to provide a central air conditioner.

A fifth objective of the present disclosure is to provide a readable storage medium.

In order to achieve the above objectives, in a first aspect, the present disclosure provides in embodiments a control method for an air conditioner water system, including: acquiring a pressure difference and a temperature difference between a water inlet pipe and a water outlet pipe of the air conditioner water system, wherein the water inlet pipe is connected to an inlet of a host module of the air conditioner water system, and the water outlet pipe is connected to an outlet of the host module of the air conditioner water system; and detecting and confirming that the pressure difference is less than or equal to a preset pressure difference, and controlling an operating frequency of a water pump of the air conditioner water system according to the pressure difference; detecting and confirming that the pressure difference is greater than the preset pressure difference, and controlling the operating frequency of the water pump of the air conditioner water system according to the temperature difference.

The control method for an air conditioner water system provided according to embodiments of the present disclosure, acquires the pressure difference and the temperature difference between the water inlet pipe and the water outlet pipe of the air conditioner water system, and controls the operating frequency of the water pump of the air conditioner water system according to the pressure difference and the temperature difference. Therefore, according to embodiments of the present disclosure, the control method for an air conditioner water system controls the operating frequency of the water pump according to the pressure difference, when the pressure difference is less than or equal to the preset pressure difference; and controls the operating frequency of the water pump according to the temperature difference, when the pressure difference is greater than the preset pressure difference, such that the operating frequency of the water pump of the air conditioner water system can be adaptively controlled when the load of the air conditioner water system changes, thus making the control more stable and timely, while saving energy.

According to some embodiments of the present disclosure, said controlling the operating frequency of a water pump of the air conditioner water system according to the pressure difference includes: calculating a pressure difference error and a pressure difference change rate according to the pressure difference and a pressure difference setting value; and controlling the operating frequency of the water pump according to the pressure difference error and the pressure difference change rate.

According to some embodiments of the present disclosure, the control method for an air conditioner water system further includes: detecting and confirming that the pressure difference error is greater than zero and the pressure difference change rate is greater than or equal to zero, increasing the pressure difference setting value, and adjusting the pressure difference setting value to be a value before increased.

According to some embodiments of the present disclosure, said controlling the operating frequency of the water pump of the air conditioner water system according to the temperature difference includes: calculating a temperature difference error and a temperature difference change rate according to the temperature difference and a temperature difference setting value; and controlling the operating frequency of the water pump according to the temperature difference error and the temperature difference change rate.

According to some embodiments of the present disclosure, the air conditioner water system includes a plurality of the water pumps, and said controlling the operating frequency of the water pump further includes: determining water pumps which are in an operating state among the plurality of the water pumps, and acquiring respective current operating frequencies of the water pumps which are in the operating state; and controlling the number of the water pumps which are in the operating state according to the respective current operating frequencies of the water pumps which are in the operating state, the pressure difference and the temperature difference.

According to some embodiments of the present disclosure, said controlling the number of the water pumps which are in the operating state according to the respective current operating frequencies of the water pumps which are in the operating state, the pressure difference and the temperature difference further includes: detecting and confirming that the respective current operating frequencies of the water pumps which are in the operating state all reach an upper frequency limit and the pressure difference is less than or equal to the pressure difference setting value, or the pressure difference is greater than the pressure difference setting value and the temperature difference is greater than a sum of the temperature difference setting value and a dead zone value, and increasing the number of the water pumps which are in the operating state; detecting and confirming that the current operating frequency of any water pump among the water pumps which are in the operating state reaches a lower frequency limit, and the pressure difference is greater than the pressure difference setting value and the temperature difference is less than a difference between the temperature difference setting value and the dead zone value, and reducing the number of the water pumps which are in the operating state.

In order to achieve the above objectives, in a second aspect, the present disclosure provides in embodiments a control device for an air conditioner water system, including: an acquiring module, configured to acquire a pressure difference and a temperature difference between a water inlet pipe and a water outlet pipe of the air conditioner water system, wherein the water inlet pipe is connected to an inlet of a host module of the air conditioner water system, and the water outlet pipe is connected to an outlet of the host module of the air conditioner water system; and a control module, configured to detect and confirm that the pressure difference is less than or equal to a preset pressure difference, and control an operating frequency of a water pump of the air conditioner water system according to the pressure difference; and detect and confirm that the pressure difference is greater than the preset pressure difference, and control the operating frequency of the water pump of the air conditioner water system according to the temperature difference.

The control device for an air conditioner water system provided according to embodiments of the present disclosure, acquires by the acquiring module the pressure difference and the temperature difference between the water inlet pipe and the water outlet pipe of the air conditioner water system, and by the control module, detects and confirms whether the pressure difference is less than the preset pressure difference and controls the operating frequency of the water pump of the air conditioner water system according to the pressure difference and the temperature difference. Therefore, according to embodiments of the present disclosure, the control device for an air conditioner water system controls the operating frequency of the water pump according to the pressure difference, when the pressure difference is less than or equal to the preset pressure difference; and controls the operating frequency of the water pump according to the temperature difference, when the pressure difference is greater than the preset pressure difference, such that the operating frequency of the water pump of the air conditioner water system can be adaptively controlled when the load of the air conditioner water system changes, thus making the control more stable and timely, while saving energy.

In order to achieve the above objectives, in a third aspect, the present disclosure provides in embodiments an air conditioner water system, including a control device for an air conditioner water system as described in the second aspect of embodiments.

The air conditioner water system provided according to embodiments of the present disclosure, by the control device for an air conditioner water system provided, controls the operating frequency of the water pump according to the pressure difference, when the pressure difference is less than or equal to the preset pressure difference; and controls the operating frequency of the water pump according to the temperature difference, when the pressure difference is greater than the preset pressure difference, such that the operating frequency of the water pump of the air conditioner water system can be adaptively controlled when the load of the air conditioner water system changes, thus making the control more stable and timely, while saving energy.

In order to achieve the above objectives, in a fourth aspect, the present disclosure provides in embodiments a central air conditioner, including an air conditioner water system as described in the third aspect of embodiments.

The central air conditioner provided according to embodiments of the present disclosure, by the air conditioner water system provided, controls the operating frequency of the water pump according to the pressure difference, when the pressure difference is less than or equal to the preset pressure difference; and controls the operating frequency of the water pump according to the temperature difference, when the pressure difference is greater than the preset pressure difference, such that the operating frequency of the water pump of the air conditioner water system can be adaptively controlled when the load of the air conditioner water system changes, thus making the control more stable and timely, while saving energy.

In order to achieve the above objectives, in a fifth aspect, the present disclosure provides in embodiments a readable storage medium having stored therein a computer program that, when executed by a processor, performs a control method for an air conditioner water system as described in the first aspect of embodiments.

The additional aspects and advantages of the present disclosure will be partly given in the following description, and some will become obvious from the following description, or be understood through the practice of this application.

BRIEF DESCRIPTION OF THE DRAWINGS

The above and/or additional aspects and advantages of the present disclosure will become obvious and understandable with the following description for embodiments by combining the drawings.

DETAILED DESCRIPTION

Figure 1:
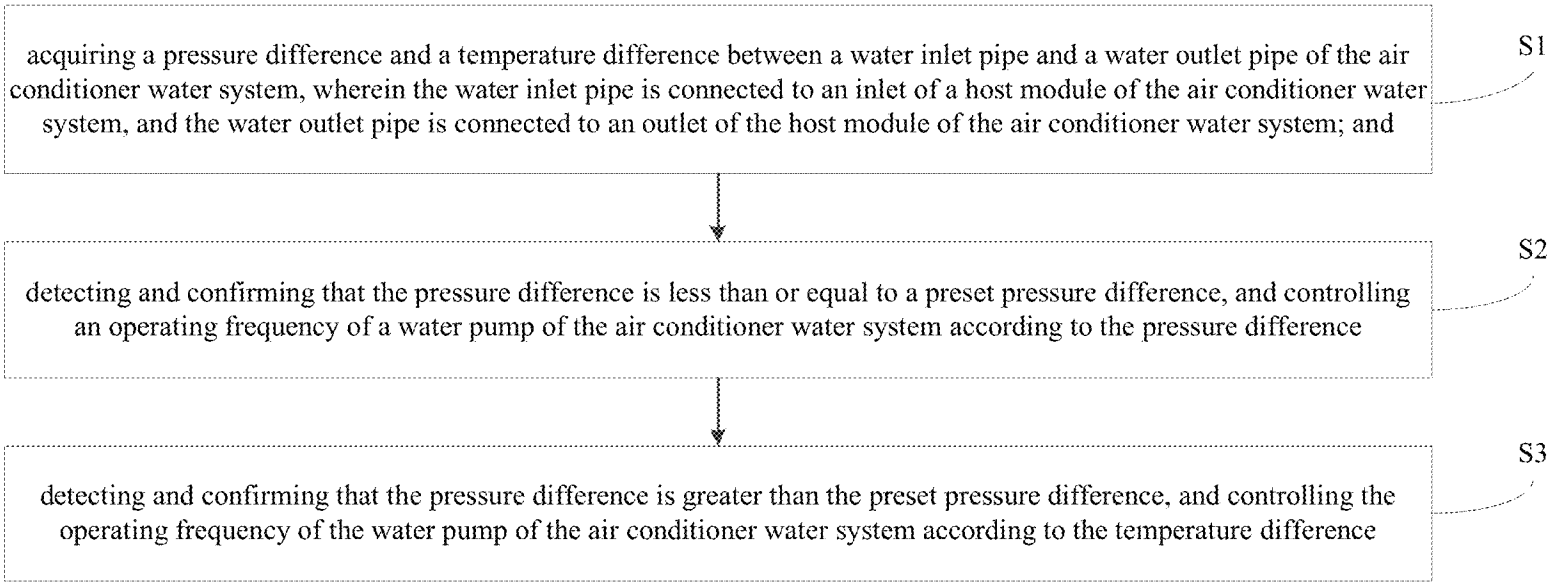
FIG. 1 is a flow chart showing a control method for an air conditioner water system according to embodiments of the present disclosure.

Reference will be made in detail to embodiments of the present disclosure. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

An air conditioner water system and its control method and control device according to embodiments of the present disclosure will be described below in conjunction with accompanying drawings.

FIG. 1 is a flow chart showing a control method for an air conditioner water system according to embodiments of the present disclosure. As shown in FIG. 1, the control method for an air conditioner water system according to some embodiments of the present disclosure includes the following steps S1 to S3.

At S1, a pressure difference and a temperature difference between a water inlet pipe and a water outlet pipe of the air conditioner water system are acquired. The water inlet pipe is connected to an inlet of a host module of the air conditioner water system, and the water outlet pipe is connected to an outlet of the host module.

It should be noted that the host module may be a water chilling unit or a heat pump unit.

It should be further noted that the pressure difference between the water inlet pipe and the water outlet pipe (i.e., a pressure difference between an inlet and outlet of the host module of the air conditioner water system) may be acquired by a pressure sensor or a pressure difference sensor. In specific, the pressure sensor may be installed at both the water inlet pipe and the water outlet pipe, to measure respective pressures at the water inlet pipe and the water outlet pipe in real-time. The resulting pressure difference therefrom is a difference between the pressure at the water inlet pipe and the pressure at the water outlet pipe. Alternatively, a pressure difference sensor may be provided between the water inlet pipe and the water outlet pipe, to measure the pressure difference between the water inlet pipe and the water outlet pipe in real-time. On the other hand, the temperature difference between the water inlet pipe and the water outlet pipe (i.e., a temperature difference between the inlet and outlet of the host module of the air conditioner water system) may be acquired by a temperature sensor. In specific, the temperature sensor may be installed at both the water inlet pipe and the water outlet pipe, to measure respective temperatures at the water inlet pipe and the water outlet pipe in real-time. The resulting temperature difference therefrom is a difference between the temperature at the water inlet pipe and the temperature at the water outlet pipe.

The water inlet pipe is connected to the inlet of the host module of the air conditioner water system, the water outlet pipe is connected to the outlet of the host module, and a water pump may be provided at the water inlet pipe of the air conditioner water system, for transporting water from the water inlet pipe to the water outlet pipe.

The pressure sensor and the temperature sensor send the pressure difference and the temperature difference between the water inlet pipe and the water outlet pipe acquired to a water pump controller, respectively. The water pump controller may be integrated in a group control system, or may be provided separately as a controller. The water pump controller communicates with a water pump power cabinet according to the pressure difference and the temperature difference between the water inlet pipe and the water outlet pipe received, so that the water pump power cabinet controls an operating frequency of the water pump, thereby controlling flow of the air conditioner water system. The water pump controller is connected to an input terminal of the water pump power cabinet, and the water pump is connected to an output terminal of the water pump power cabinet. In addition, it should be noted that the water pump controller may be used to control a freezing water pump set or a cooling water pump set for a water-cooling system; or may be used to control a freezing water pump set for an air-cooling system.

At S2, it is detected and confirmed that the pressure difference is less than or equal to a preset pressure difference, and an operating frequency of a water pump of the air conditioner water system is controlled according to the pressure difference.

The preset pressure difference may be a pressure difference corresponding to the lowest flow allowed by the host module of the air conditioner water system.

Figure 2:
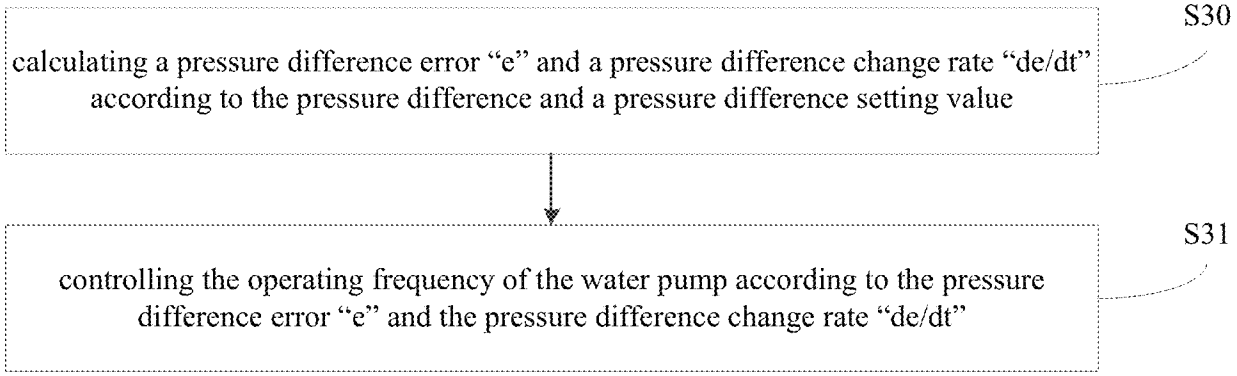
FIG. 2 is a flow chart showing a control method for an air conditioner water system according to some embodiments of the present disclosure.

According to some embodiments of the present disclosure, as shown in FIG. 2, said controlling an operating frequency of a water pump of the air conditioner water system according to the pressure difference includes the following steps S30 to S31.

At S30, a pressure difference error "e" and a pressure difference change rate "de/dt" are calculated according to the pressure difference and a pressure difference setting value.

The pressure difference setting value may be a pressure difference value between the water inlet pipe and the water outlet pipe of the air conditioner water system, which is set in advance. The pressure difference error "e" may be a difference value between the pressure difference setting value and the pressure difference (i.e., an actual measured value of the pressure difference), and the pressure difference change rate "de/dt" may be a ratio of a change in the pressure difference error to a time period taken for said change in the pressure difference error.

At S31, the operating frequency of the water pump is controlled according to the pressure difference error "e" and the pressure difference change rate "de/dt".

Figure 3:
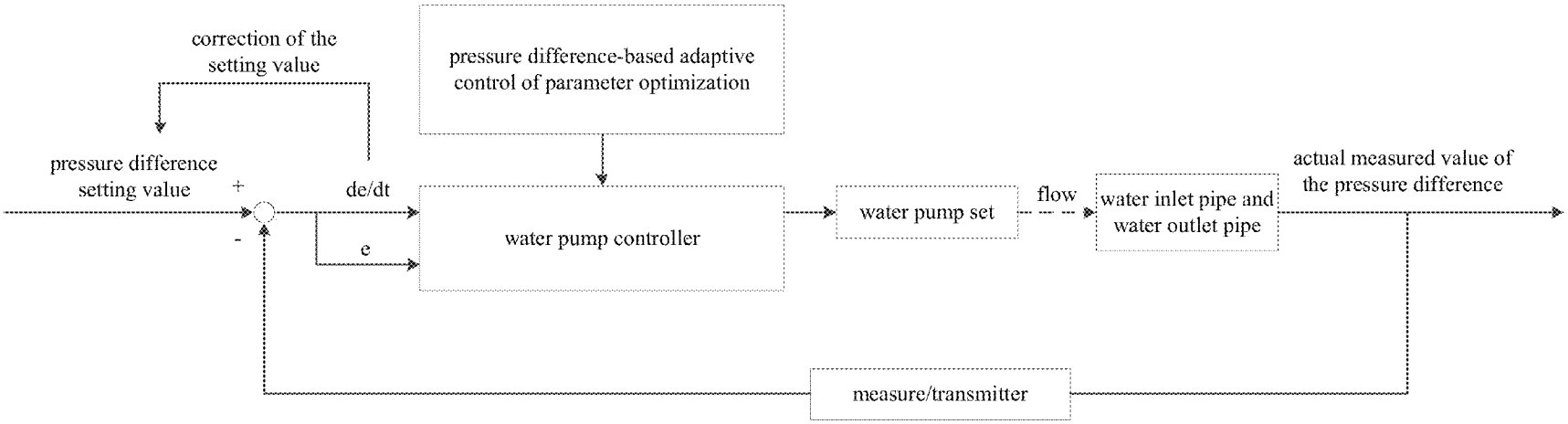
FIG. 3 is a block diagram showing controlling an operating frequency of a water pump of an air conditioner water system according to a pressure difference in a control method for an air conditioner water system according to some embodiments of the present disclosure.

It would be understood that, as shown in FIG. 3, the pressure difference between the water inlet pipe and the water outlet pipe is measured in real-time by the pressure sensor or the pressure difference sensor, thereby obtaining the actual measured value of the pressure difference, which is converted by a transmitter for comparison with the pressure difference setting value, thereby obtaining the pressure difference error "e" and the pressure difference change rate "de/dt". The water pump controller adaptively optimizes pressure difference control parameters according to the pressure difference error "e" and the pressure difference change rate "de/dt", so as to optimally control the operating frequency of the water pump, thereby adjusting a rotation speed of the water pump, and then adjusting the flow of the air conditioner water system, thus achieving operation at variable flows of the air conditioner water system. In specific, the optimal control parameters can be found through algorithms such as fuzzy control, neural network control, and group intelligent optimization control, so as to adapt to a large-lag and time-varying system, thus making the control more stable and response faster.

According to some embodiments of the present disclosure, it is detected and confirmed that the pressure difference error "e" is greater than zero and the pressure difference change rate "de/dt" is greater than or equal to zero, the pressure difference setting value is increased, and the pressure difference setting value is then adjusted to be the value before increased.

It would be understood that when the pressure difference error "e" is greater than zero (i.e., $e>0$) and the pressure difference change rate "de/dt" is greater than or equal to zero (i.e., $de/dt \geq 0$), the pressure of the air conditioner water system is not stable, and the air conditioner water system is in a state where the flow is not increasing or is decreasing too fast, which may cause a water cut failure at the host side of the system. At this time, the pressure difference setting value is increased, that is, to perform adaptive correction for variable pressure differences, so that the frequency of the water pump can respond quickly, and the flow of the air conditioner water system is increased accordingly, such that the system will not be in a dangerous state of lack of flow. When the system is restored to a stable operating state that meets reliability, that is, after the adaptive correction for the variable pressure differences reaches a preset time period, the pressure difference setting value is adjusted to the value before increased.

At S3, it is detected and confirmed that the pressure difference is greater than the preset pressure difference, and the operating frequency of the water pump of the air conditioner water system is controlled according to the temperature difference.

Figure 4:
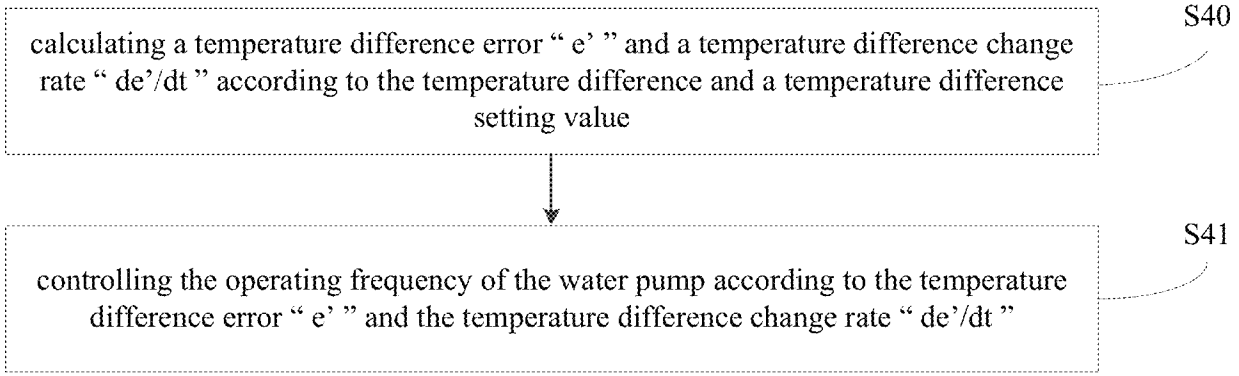
FIG. 4 is a flow chart showing a control method for an air conditioner water system according to another embodiment of the present disclosure.

According to some embodiments of the present disclosure, as shown in FIG. 4, said controlling the operating frequency of the water pump of the air conditioner water system according to the temperature difference includes the following steps S40 to S41.

At S40, a temperature difference error "e'" and a temperature difference change rate "de'/dt" are calculated according to the temperature difference and a temperature difference setting value.

The temperature difference setting value may be a temperature difference value between the water inlet pipe and the water outlet pipe of the air conditioner water system, which is set in advance. The temperature difference error "e'" may be a difference value between the temperature difference setting value and the temperature difference (i.e., an actual measured value of the temperature difference), and the temperature difference change rate "de'/dt" may be a ratio of a change in the temperature difference error to a time period taken for said change in the temperature difference error.

At S41, the operating frequency of the water pump is controlled according to the temperature difference error "e'" and the temperature difference change rate "de'/dt".

Figure 5:
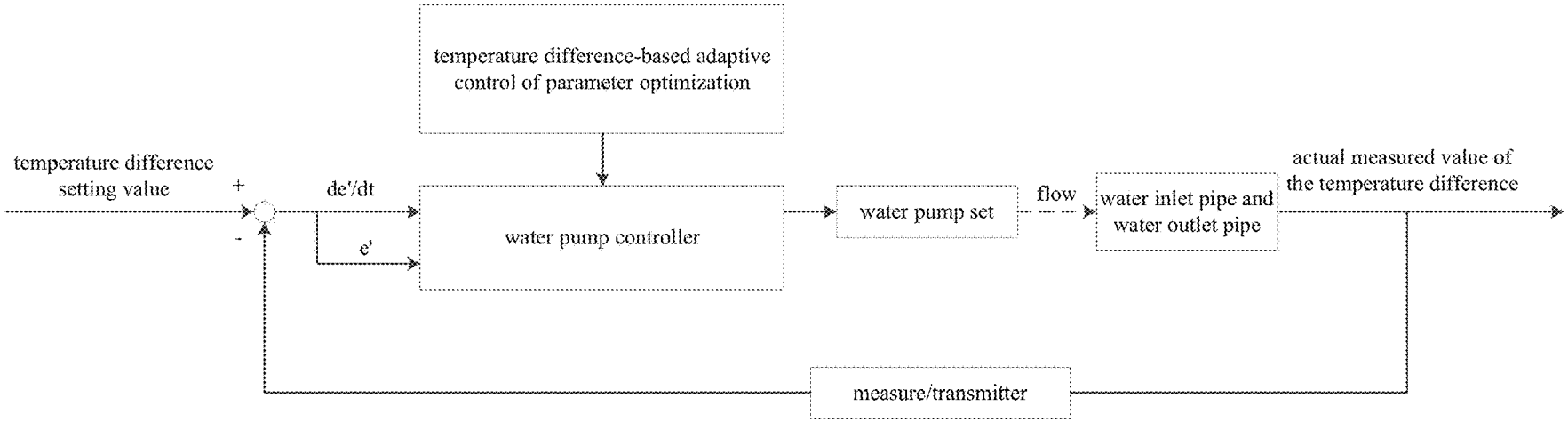
FIG. 5 is a block diagram showing controlling an operating frequency of a water pump of an air conditioner water system according to a temperature difference in a control method for an air conditioner water system according to another embodiment of the present disclosure.

It would be understood that, as shown in FIG. 5, the temperature difference between the water inlet pipe and the water outlet pipe is measured in real-time by a temperature sensor, thereby obtaining the actual measured value of the temperature difference, which is converted by a transmitter for comparison with the temperature difference setting value, thereby obtaining the temperature difference error "e'" and the temperature difference change rate "de'/dt". The water pump controller adaptively optimizes temperature difference control parameters according to the temperature difference error "e'" and the temperature difference change rate "de'/dt", so as to optimally control the operating frequency of the water pump, thereby adjusting a rotation speed of the water pump, and then adjusting the flow of the air conditioner water system, thus achieving operation at variable flows of the air conditioner water system. In specific, the optimal control parameters can be found through algorithms such as fuzzy control, neural network control, and group intelligent optimization control, so as to adapt to a large-lag and time-varying system, thus making the control more stable and response faster.

Figure 6:
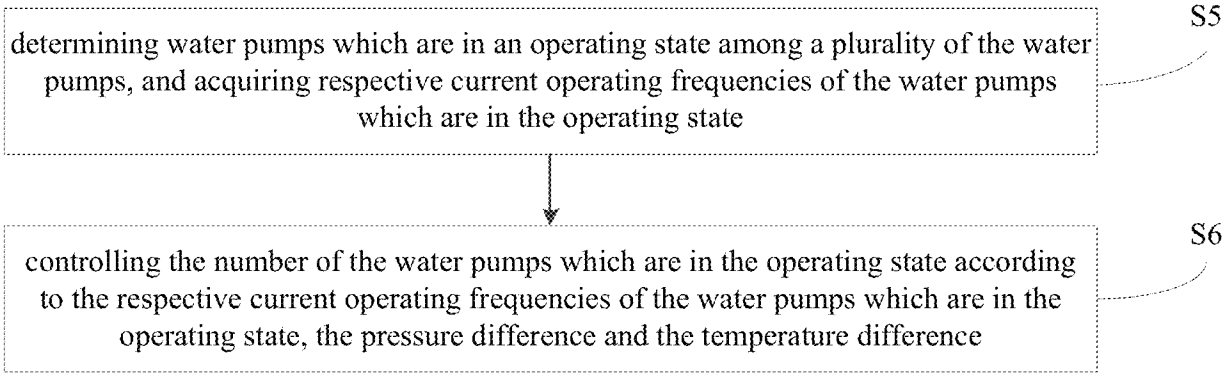
FIG. 6 is a flow chart showing a control method for an air conditioner water system according to still another embodiment of the present disclosure.

Further, according to some embodiments of the present disclosure, the air conditioner water system includes a plurality of the water pumps. As shown in FIG. 6, said controlling the operating frequency of the water pump further includes the following steps S5 to S6.

At S5, water pumps which are in an operating state among the plurality of the water pumps are determined, and respective current operating frequencies of the water pumps which are in the operating state are acquired.

A rotation speed of the water pump may be detected by a rotation speed sensor (such as a Hall Sensor) installed at a drive shaft of the water pump. When it is detected that the rotation speed of the water pump is greater than zero, it indicates that the water pump is in the operating state.

At S6, the number of the water pumps which are in the operating state is controlled according to the respective current operating frequencies of the water pumps which are in the operating state, the pressure difference and the temperature difference between the water inlet pipe and the water outlet pipe of the air conditioner water system.

In specific, in some embodiments of the present disclosure, said controlling the number of the water pumps which are in the operating state according to the respective current operating frequencies of the water pumps which are in the operating state, the pressure difference and the temperature difference further includes: detecting and confirming that the respective current operating frequencies of the water pumps which are in the operating state all reach an upper frequency limit and the pressure difference is less than or equal to the pressure difference setting value, or the pressure difference is greater than the pressure difference setting value and the temperature difference is greater than a sum of the temperature difference setting value and a dead zone value, and increasing the number of the water pumps which are in the operating state; detecting and confirming that the current operating frequency of any water pump among the water pumps which are in the operating state reaches a lower frequency limit, and the pressure difference is greater than the pressure difference setting value and the temperature difference is less than a difference between the temperature difference setting value and the dead zone value, and reducing the number of the water pumps which are in the operating state.

The dead zone value may be a temperature difference control margin that is set in advance, the upper frequency limit may be the maximum value that the operating frequency of the water pump can reach, and the lower frequency limit may be the minimum value that the operating frequency of the water pump can reach.

For example, it is assumed that 3 water pumps are in the operating state and respective current operating frequencies of the 3 water pumps all reach the upper frequency limit, when the pressure difference is less than or equal to the pressure difference setting value, or the pressure difference is greater than the pressure difference setting value and the temperature difference is greater than a sum of the temperature difference setting value and a dead zone value, then the number of the water pumps which are in the operating state is increased, after which 4 water pumps are in the operating state. It is assumed that 3 water pumps are in the operating state and the current operating frequency of any water pump in the 3 water pumps reaches the lower frequency limit, when the pressure difference is greater than the pressure difference setting value and the temperature difference is less than a difference between the temperature difference setting value and the dead zone value, then the number of the water pumps which are in the operating state is reduced.

Figure 8:
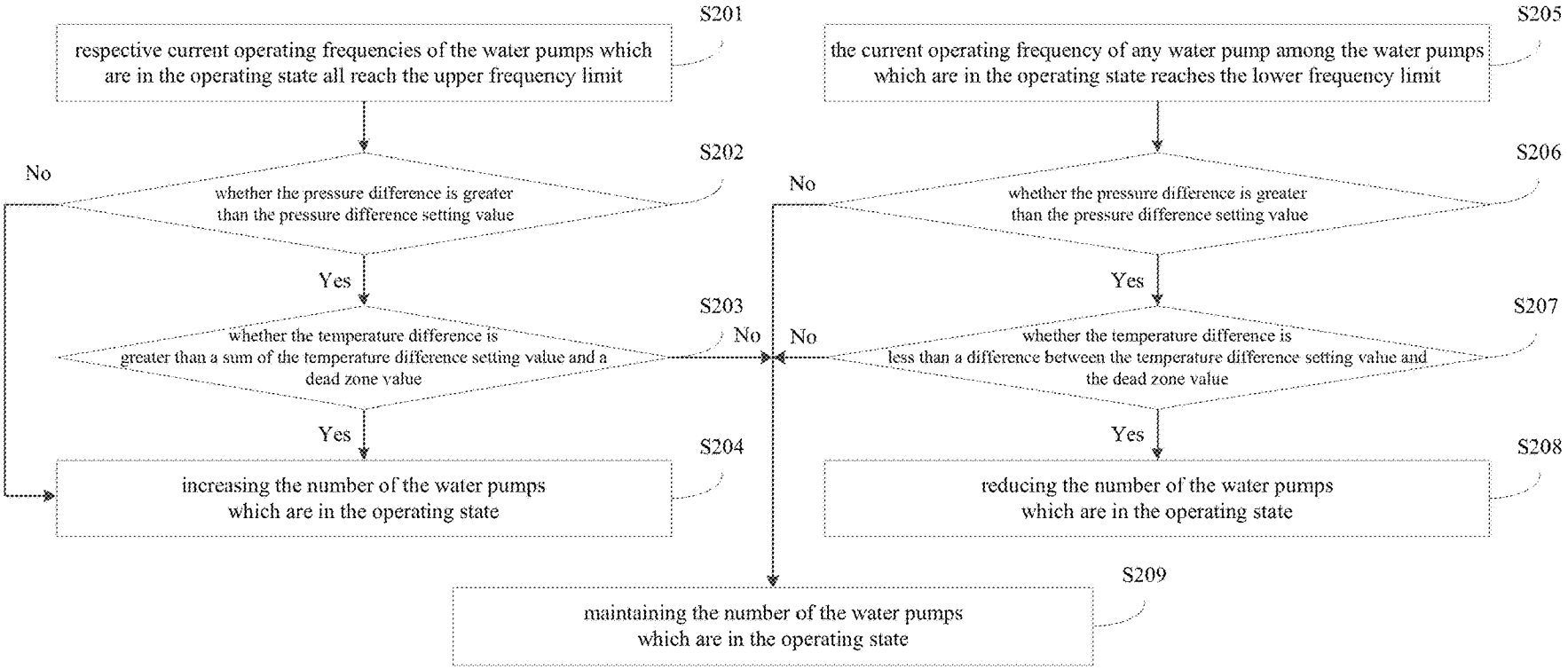
FIG. 8 is a flow chart showing a control method for an air conditioner water system according to another specific embodiment of the present disclosure.

As shown in FIG. 8, said controlling the number of the water pumps which are in the operating state according to respective current operating frequencies of the water pumps which are in the operating state, the pressure difference and the temperature difference specifically includes the following steps S201 to S209.

At S201, respective current operating frequencies of the water pumps which are in the operating state all reach the upper frequency limit.

At S202, it is judged whether the pressure difference is greater than the pressure difference setting value.

If yes, the step S203 is executed; if no, the step S204 is executed.

At S203, it is judged whether the temperature difference is greater than the sum of the temperature difference setting value and a dead zone value.

If yes, the step S204 is executed; if no, the step S209 is executed.

At S204, the number of the water pumps which are in the operating state is increased.

At S205, the current operating frequency of any water pump among the water pumps which are in the operating state reaches the lower frequency limit.

At S206, it is judged whether the pressure difference is greater than the pressure difference setting value.

If yes, the step S207 is executed; if no, the step S209 is executed.

At S207, it is judged whether the temperature difference is less than a difference between the temperature difference setting value and the dead zone value.

If yes, the step S208 is executed; if no, the step S209 is executed.

At S208, the number of the water pumps which are in the operating state is reduced.

At S209, the number of the water pumps which are in the operating state is maintained.

Figure 7:
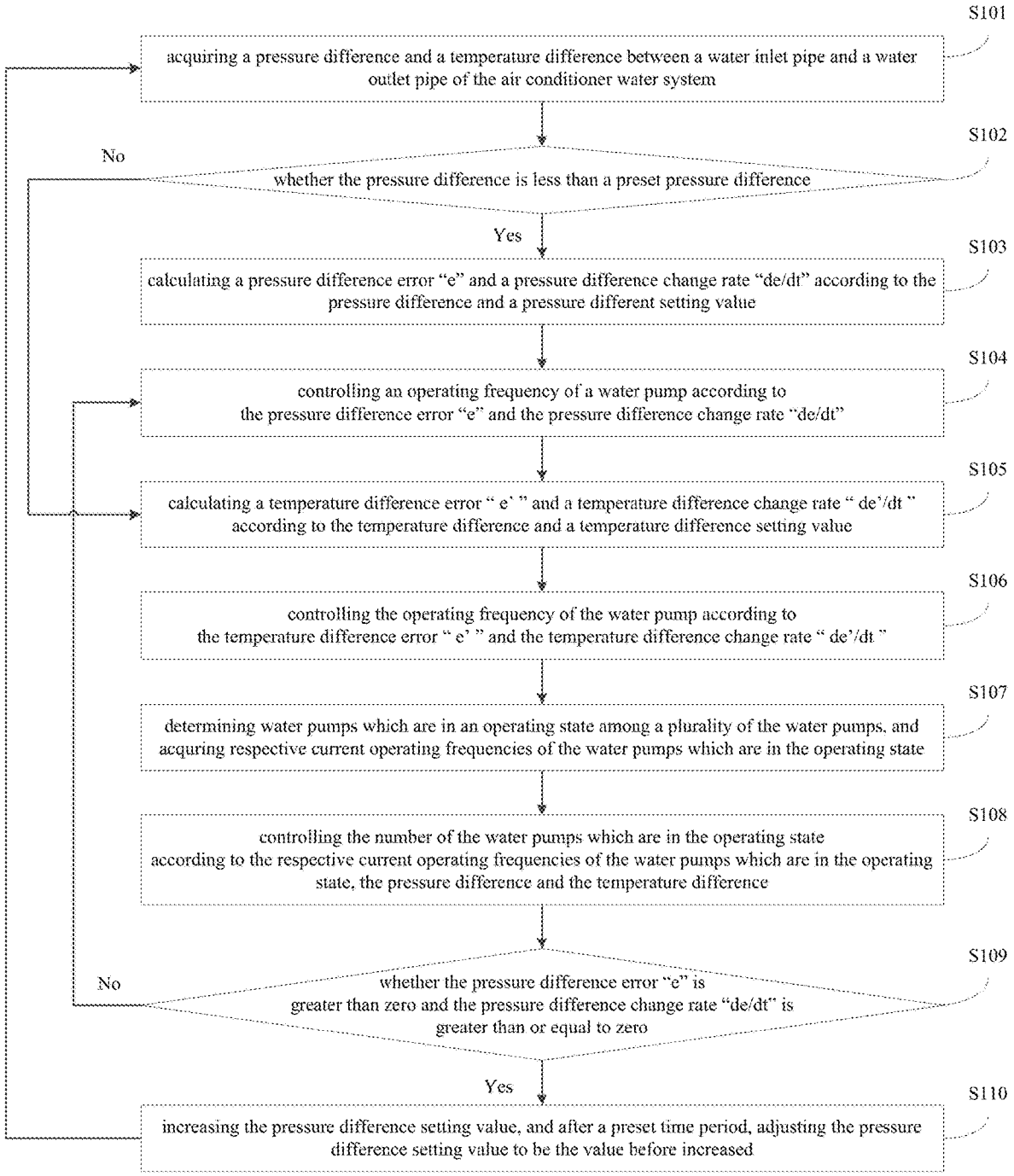
FIG. 7 is a flow chart showing a control method for an air conditioner water system according to a specific embodiment of the present disclosure.

As described above, as shown in FIG. 7, in some embodiments of the present disclosure, the control method for an air conditioner water system may include the following steps S101 to S110.

At S101, a pressure difference and a temperature difference between a water inlet pipe and a water outlet pipe of the air conditioner water system are acquired.

At S102, it is judged whether the pressure difference is less than a preset pressure difference.

If yes, the step S103 is executed; if no, the step S105 is executed.

At S103, a pressure difference error "e" and a pressure difference change rate "de/dt" are calculated according to the pressure difference and a pressure different setting value.

At S104, an operating frequency of a water pump is controlled according to the pressure difference error "e" and the pressure difference change rate "de/dt".

At S105, a temperature difference error "e'" and a temperature difference change rate "de'/dt" are calculated according to the temperature difference and a temperature difference setting value.

At S106, the operating frequency of the water pump is controlled according to the temperature difference error "e'" and the temperature difference change rate "de'/dt".

At S107, water pumps which are in an operating state among a plurality of the water pumps are determined, and respective current operating frequencies of the water pumps which are in the operating state are acquired.

At S108, the number of the water pumps which are in the operating state is controlled according to the respective current operating frequencies of the water pumps which are in the operating state, the pressure difference and the temperature difference.

At S109, it is judged whether the pressure difference error "e" is greater than zero and the pressure difference change rate "de/dt" is greater than or equal to zero.

If yes, the step S110 is executed; if no, the step S104 is executed.

At S110, the pressure difference setting value is increased, and after a preset time period, the pressure difference setting value is then adjusted to be the value before increased, and the step S101 is executed again.

In summary, the control method for an air conditioner water system provided according to embodiments of the present disclosure, acquires the pressure difference and the temperature difference between the water inlet pipe and the water outlet pipe of the air conditioner water system, and controls the operating frequency of the water pump of the air conditioner water system according to the pressure difference and the temperature difference. Therefore, according to embodiments of the present disclosure, the control method for an air conditioner water system controls the operating frequency of the water pump according to the pressure difference, when the pressure difference is less than or equal to the preset pressure difference; and controls the operating frequency of the water pump according to the temperature difference, when the pressure difference is greater than the preset pressure difference, such that the operating frequency of the water pump of the air conditioner water system can be adaptively controlled when the load of the air conditioner water system changes, thus making the control more stable and timely, while saving energy.

Based on the control method for an air conditioner water system as described in the above embodiments, the present disclosure further provides in embodiments a control device for an air conditioner water system.

Figure 9:
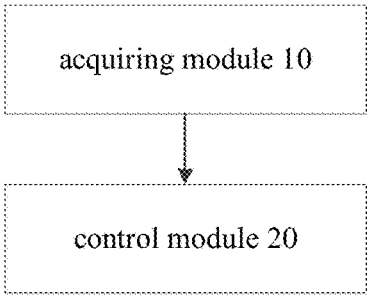
FIG. 9 is a block diagram showing a control device for an air conditioner water system according to embodiments of the present disclosure.

FIG. 9 is a block diagram showing a control device for an air conditioner water system according to embodiments of the present disclosure. As shown in FIG. 9, in some embodiments of the present disclosure, the control device for an air conditioner water system includes an acquiring module 10 and a control module 20.

The acquiring module 10 is configured to acquire a pressure difference and a temperature difference between a water inlet pipe and a water outlet pipe of the air conditioner water system. The water inlet pipe is connected to an inlet of a host module of the air conditioner water system, and the water outlet pipe is connected to an outlet of the host module. The control module 20 is configured to detect and confirm that the pressure difference is less than or equal to a preset pressure difference, and control an operating frequency of a water pump of the air conditioner water system according to the pressure difference; and detect and confirm that the pressure difference is greater than the preset pressure difference, and control the operating frequency of the water pump of the air conditioner water system according to the temperature difference.

It should be noted that the host module may be a water chilling unit or a heat pump unit.

It would be understood that the acquiring module 10 may include a pressure sensor or a pressure difference sensor and a temperature sensor; and the control module 20 may include a water pump controller 21. The pressure difference between the water inlet pipe and the water outlet pipe (i.e., a pressure difference between an inlet and outlet of the host module of the air conditioner water system) may be acquired by the pressure sensor or the pressure difference sensor. In specific, the pressure sensor may be installed at both the water inlet pipe and the water outlet pipe, to measure respective pressures at the water inlet pipe and the water outlet pipe in real-time. The resulting pressure difference therefrom is a difference between the pressure at the water inlet pipe and the pressure at the water outlet pipe. Alternatively, a pressure difference sensor may be provided between the water inlet pipe and the water outlet pipe, to measure the pressure difference between the water inlet pipe and the water outlet pipe in real-time. On the other hand, the temperature difference between the water inlet pipe and the water outlet pipe (i.e., a temperature difference between the inlet and outlet of the host module of the air conditioner water system) may be acquired by a temperature sensor. In specific, the temperature sensor may be installed at both the water inlet pipe and the water outlet pipe, to measure respective temperatures at the water inlet pipe and the water outlet pipe in real-time. The resulting temperature difference therefrom is a difference between the temperature at the water inlet pipe and the temperature at the water outlet pipe.

The water inlet pipe is connected to an inlet of a host module of the air conditioner water system, the water outlet pipe is connected to an outlet of the host module of the air conditioner water system, and a water pump may be provided at the water inlet pipe of the air conditioner water system, for transporting water from the water inlet pipe to the water outlet pipe.

Figure 10:
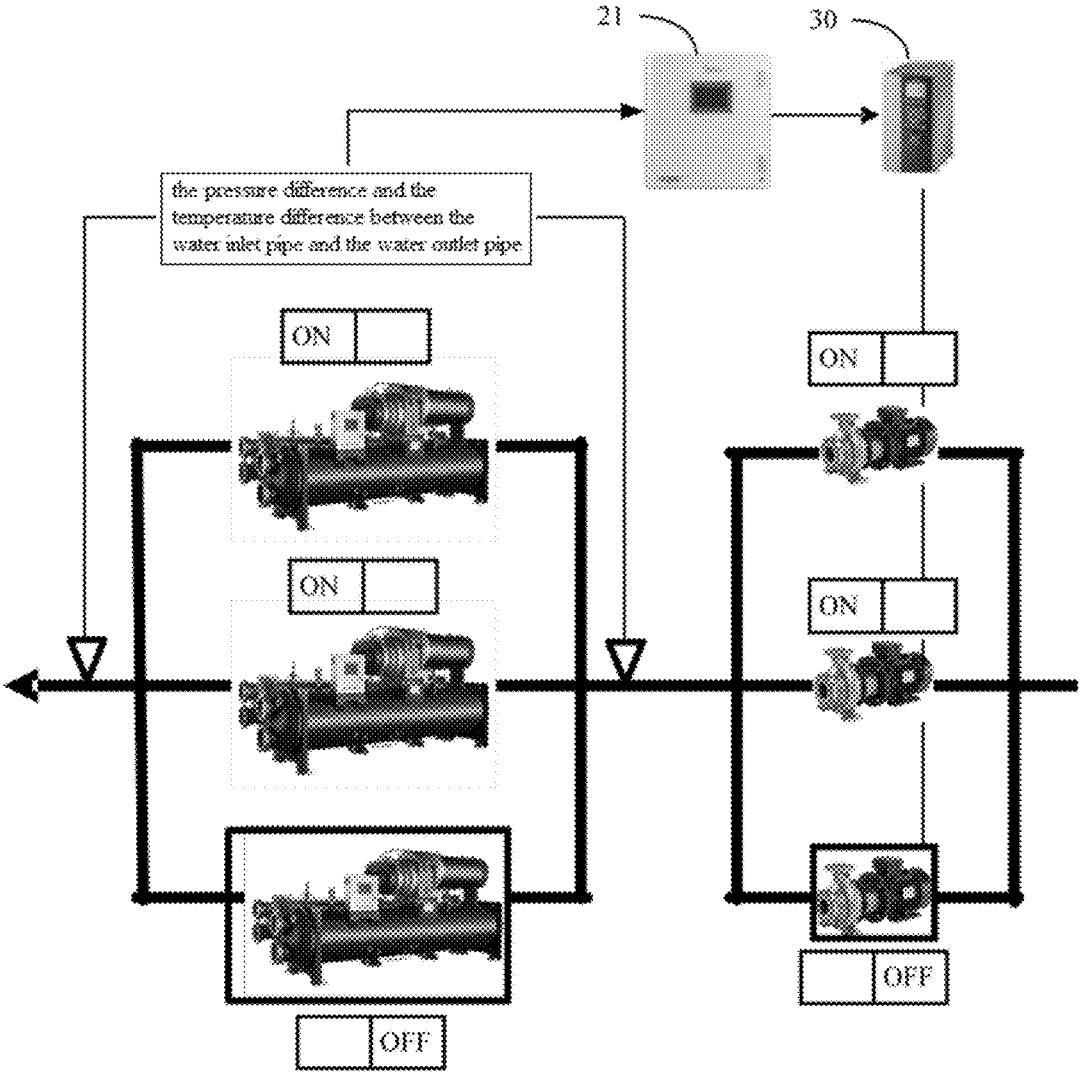
FIG. 10 is a schematic diagram showing installation of a water pump controller, in a control device for an air conditioner water system according to some embodiments of the present disclosure, on a water-cooling system-based central air conditioner.
Figure 11:
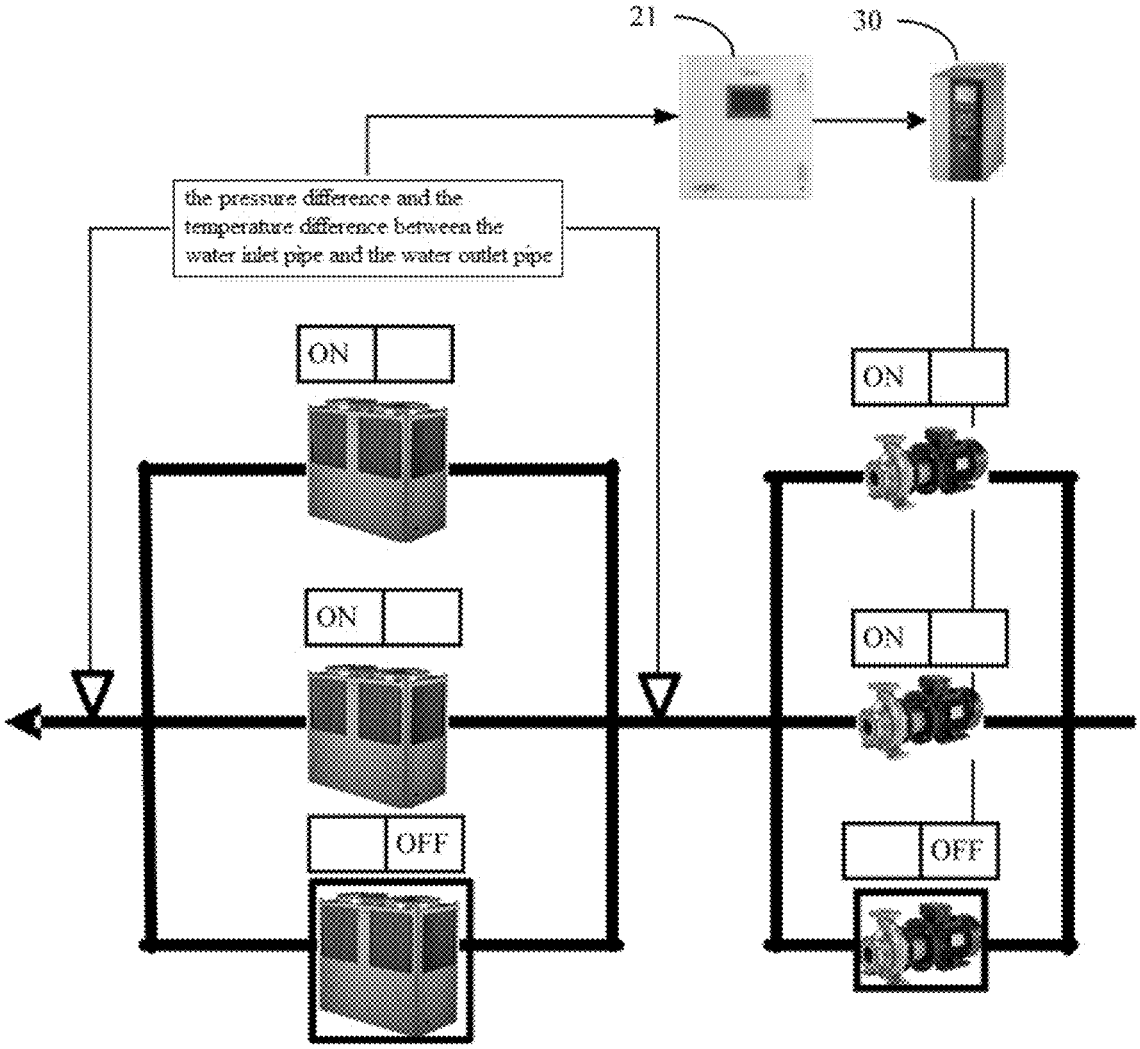
FIG. 11 is a schematic diagram showing installation of a water pump controller, in to a control device for an air conditioner water system according to some embodiments of the present disclosure, on an air-cooling system-based central air conditioner.

The pressure sensor or the pressure difference sensor and the temperature sensor send the pressure difference and the temperature difference between the water inlet pipe and the water outlet pipe acquired to a water pump controller 21, respectively. The water pump controller 21 may be integrated in a group control system, as shown in FIGS. 10-11; or may be provided separately as a controller. The water pump controller 21 communicates with a water pump power cabinet 30 according to the pressure difference and the temperature difference between the water inlet pipe and the water outlet pipe received, so that the water pump power cabinet 30 controls the operating frequency of the water pump, thereby controlling flow of the air conditioner water system. The water pump controller 21 is connected to an input terminal of the water pump power cabinet 30, and the water pump is connected to an output terminal of the water pump power cabinet 30.

It should be further noted that the above explanation and illustration to the control method for an air conditioner water system as described in embodiments of the present disclosure may be also applicable for the control device for an air conditioner water system as described in embodiments of the present disclosure, which is not repeated here.

In summary, the control device for an air conditioner water system provided according to embodiments of the present disclosure, acquires by the acquiring module the pressure difference and the temperature difference between the water inlet pipe and the water outlet pipe of the air conditioner water system, and by the control module, detects and confirms that the pressure difference is less than or equal to the preset pressure difference, and controls the operating frequency of the water pump of the air conditioner water system according to the pressure difference; and detects and confirms that the pressure difference is greater than the preset pressure difference, and controls the operating frequency of the water pump of the air conditioner water system according to the temperature difference. Therefore, according to embodiments of the present disclosure, the control device for an air conditioner water system controls the operating frequency of the water pump according to the pressure difference, when the pressure difference is less than or equal to the preset pressure difference; and controls the operating frequency of the water pump according to the temperature difference, when the pressure difference is greater than the preset pressure difference, such that the operating frequency of the water pump of the air conditioner water system can be adaptively controlled when the load of the air conditioner water system changes, thus making the control more stable and timely, while saving energy.

Based on the control device for an air conditioner water system as described in the above embodiments, the present disclosure further provides in embodiments an air conditioner water system, including a control device for an air conditioner water system as described above.

The air conditioner water system provided according to embodiments of the present disclosure, by the control device for an air conditioner water system provided, controls the operating frequency of the water pump according to the pressure difference, when the pressure difference is less than or equal to the preset pressure difference; and controls the operating frequency of the water pump according to the temperature difference, when the pressure difference is greater than the preset pressure difference, such that the operating frequency of the water pump of the air conditioner water system can be adaptively controlled when the load of the air conditioner water system changes, thus making the control more stable and timely, while saving energy.

Based on the air conditioner water system as described in the above embodiments, the present disclosure further provides in embodiments a central air conditioner, including an air conditioner water system as described above.

The central air conditioner provided according to embodiments of the present disclosure, by the air conditioner water system provided, controls the operating frequency of the water pump according to the pressure difference, when the pressure difference is less than or equal to the preset pressure difference; and controls the operating frequency of the water pump according to the temperature difference, when the pressure difference is greater than the preset pressure difference, such that the operating frequency of the water pump of the air conditioner water system can be adaptively controlled when the load of the air conditioner water system changes, thus making the control more stable and timely, while saving energy.

Based on the control method for an air conditioner water system as described in the above embodiments, the present disclosure further provides in embodiments a readable storage medium having stored therein a computer program that, when executed by a processor, performs the control method for an air conditioner water system as described above.

In the specification, it should be understood that, the terms indicating orientation or position relationship such as "central", "longitudinal", "lateral", "width", "thickness", "above", "below", "front", "rear", "right", "left", "vertical", "horizontal", "top", "bottom", "inner", "outer", "clockwise", "counter-clockwise", "axial", "radial", "circumferential" should be construed to refer to the orientation or position relationship as described or as shown in the drawings. These terms are merely for convenience and concision of description and do not alone indicate or imply that the device or element referred to must have a particular orientation or must be configured or operated in a particular orientation. Thus, it cannot be understood to limit the present disclosure.

In addition, terms such as "first" and "second" are used herein for purposes of description and are not intended to indicate or imply relative importance or significance or impliedly indicate quantity of the technical feature referred to. Thus, the feature defined with "first" and "second" may include one or more this features. In the description of the present disclosure, "a plurality of" means two or more than two this features, unless specified otherwise.

In the present disclosure, unless specified or limited otherwise, the terms "mounted", "connected", "coupled", "fixed" and the like are used broadly, and may be, for example, fixed connections, detachable connections, or integrated connections; may also be mechanical or electrical connections; may also be direct connections or indirect connections via intervening structures; may also be inner communications of two elements or mutual interaction between two elements, which can be understood by those skilled in the art according to specific situations.

In the present disclosure, unless specified or limited otherwise, a structure in which a first feature is "on" or "below" a second feature may be some embodiments in which the first feature is in direct contact with the second feature, or some embodiments in which the first feature and the second feature are contacted indirectly via an intermediation. Furthermore, a first feature "on", "above" or "on top of" a second feature may include some embodiments in which the first feature is right or obliquely "on", "above" or "on top of" the second feature, or just means that the first feature is at a height higher than that of the second feature; while a first feature "below", "under" or "on bottom of" a second feature may include some embodiments in which the first feature is right or obliquely "below", "under" or "on bottom of" the second feature, or just means that the first feature is at a height lower than that of the second feature.

Reference throughout this specification to "an embodiment", "some embodiments", "one embodiment", "another example", "an example", "a specific example" or "some examples" means that a particular feature, structure, material, or characteristic described in connection with the embodiment or example is included in at least one embodiment or example of the present disclosure. Thus, the appearances of the phrases such as "in some embodiments", "in one embodiment", "in an embodiment", "in another example", "in an example", "in a specific example" or "in some examples" in various places throughout this specification are not necessarily referring to the same embodiment or example of the present disclosure. Furthermore, the particular features, structures, materials, or characteristics may be combined in any suitable manner in one or more embodiments or examples. In addition, those skilled in the art can unite and combine different embodiments or examples and the features in different embodiments or examples described in this specification without contradicting each other.

Although explanatory embodiments have been shown and described, it would be appreciated by those skilled in the art that the above embodiments cannot be construed to limit the present disclosure, and changes, alternatives, and modifications can be made in the embodiments in the scope of the present disclosure.

What is claimed is:

1. A control method for an air conditioner water system, comprising:

acquiring a pressure difference and a temperature difference between a water inlet pipe and a water outlet pipe of the air conditioner water system, wherein the water inlet pipe is connected to an inlet of a host module of the air conditioner water system, and the water outlet pipe is connected to an outlet of the host module of the air conditioner water system; and detecting and confirming that the pressure difference is less than or equal to a preset pressure difference, and controlling an operating frequency of a water pump of the air conditioner water system according to the pressure difference;

detecting and confirming that the pressure difference is greater than the preset pressure difference, and controlling the operating frequency of the water pump of the air conditioner water system according to the temperature difference, wherein said controlling an operating frequency of a water pump of the air conditioner water system according to the pressure difference comprises:

calculating a pressure difference error and a pressure difference change rate according to the pressure difference and a pressure difference setting value; and controlling the operating frequency of the water pump according to the pressure difference error and the pressure difference change rate, and the method comprising:

detecting and confirming that the pressure difference error is greater than zero and the pressure difference change rate is greater than or equal to zero, increasing the pressure difference setting value from a first value to a second value, and adjusting the pressure difference setting value back to the first value.

2. The control method for an air conditioner water system according to claim 1, wherein said controlling the operating frequency of the water pump of the air conditioner water system according to the temperature difference comprises:

calculating a temperature difference error and a temperature difference change rate according to the temperature difference and a temperature difference setting value; and controlling the operating frequency of the water pump according to the temperature difference error and the temperature difference change rate.

3. The control method for an air conditioner water system according to claim 1, wherein the air conditioner water system comprises a plurality of water pumps, and said controlling the operating frequency of the water pump further comprises:

determining water pumps which are in an operating state among the plurality of water pumps, and acquiring respective current operating frequencies of the water pumps which are in the operating state; and controlling a number of the water pumps which are in the operating state according to the respective current operating frequencies of the water pumps which are in the operating state, the pressure difference and the temperature difference.

4. The control method for an air conditioner water system according to claim 3, wherein said controlling the number of the water pumps which are in the operating state according to the respective current operating frequencies of the water pumps which are in the operating state, the pressure difference and the temperature difference further comprises:

detecting and confirming that the respective current operating frequencies of the water pumps which are in the operating state all reach an upper frequency limit and the pressure difference is less than or equal to a pressure difference setting value, or the pressure difference is greater than the pressure difference setting value and the temperature difference is greater than a sum of a temperature difference setting value and a dead zone value, and increasing the number of the water pumps which are in the operating state; and detecting and confirming that the current operating frequency of any water pump among the water pumps which are in the operating state reaches a lower frequency limit, and the pressure difference is greater than the pressure difference setting value and the temperature difference is less than a difference between the temperature difference setting value and the dead zone value, and reducing the number of the water pumps which are in the operating state.

5. A non-transitory readable storage medium having stored therein a computer program that, when executed by a processor, performs a control method for the air conditioner water system according to claim 1.

6. A control device for an air conditioner water system, comprising:

an acquiring module, configured to acquire a pressure difference and a temperature difference between a water inlet pipe and a water outlet pipe of the air conditioner water system, wherein the water inlet pipe is connected to an inlet of a host module of the air conditioner water system, and the water outlet pipe is connected to an outlet of the host module of the air conditioner water system; and a control module, configured to detect and confirm that the pressure difference is less than or equal to a preset pressure difference, and control an operating frequency of a water pump of the air conditioner water system according to the pressure difference;

detect and confirm that the pressure difference is greater than the preset pressure difference, and control the operating frequency of the water pump of the air conditioner water system according to the temperature difference, wherein said controlling an operating frequency of a water pump of the air conditioner water system according to the pressure difference comprises:

calculating a pressure difference error and a pressure difference change rate according to the pressure difference and a pressure difference setting value; and controlling the operating frequency of the water pump according to the pressure difference error and the pressure difference change rate, and the control module is further configured to:

detect and confirm that the pressure difference error is greater than zero and the pressure difference change rate is greater than or equal to zero, increase the pressure difference setting value from a first value to a second value, and adjust the pressure difference setting value back to the first value.

7. An air conditioner water system, comprising the control device for the air conditioner water system according to claim 6.

8. A central air conditioner, comprising the air conditioner water system according to claim 7.

* * * * *